US011807975B2

(12) United States Patent
Ryu et al.

(10) Patent No.: US 11,807,975 B2
(45) Date of Patent: Nov. 7, 2023

(54) WATER TEMPERATURE EVALUATION METHOD USING A HUMIDITY SENSOR IN A LAUNDRY APPLIANCE

(71) Applicant: Haier US Appliance Solutions, Inc., Wilmington, DE (US)

(72) Inventors: SeongHoon Ryu, Seoul (KR); Hyoyeol Maeng, Bucheon-si (KR); Wonmyung Seo, Gyeonggi-do (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 29 days.

(21) Appl. No.: 17/501,178

(22) Filed: Oct. 14, 2021

(65) Prior Publication Data

US 2023/0122159 A1 Apr. 20, 2023

(51) Int. Cl.

| | |
|---|---|
| ***D06F 33/47*** | (2020.01) |
| ***D06F 34/26*** | (2020.01) |
| ***D06F 33/34*** | (2020.01) |
| *D06F 34/24* | (2020.01) |
| *D06F 21/04* | (2006.01) |
| *D06F 34/06* | (2020.01) |
| *D06F 105/62* | (2020.01) |
| *D06F 34/05* | (2020.01) |
| *D06F 103/16* | (2020.01) |
| *D06F 103/34* | (2020.01) |
| *D06F 105/02* | (2020.01) |

(52) U.S. Cl.

CPC ..... *D06F 33/47* (2020.02); *D06F 33/34* (2020.02); *D06F 34/26* (2020.02); *D06F 21/04* (2013.01); *D06F 34/05* (2020.02); *D06F 34/06* (2020.02); *D06F 34/24* (2020.02); *D06F 2103/16* (2020.02); *D06F 2103/34* (2020.02); *D06F 2105/02* (2020.02); *D06F 2105/62* (2020.02)

(58) Field of Classification Search

CPC ..... D06F 33/47; D06F 34/26; D06F 33/34
See application file for complete search history.

(56) References Cited

U.S. PATENT DOCUMENTS

| | | | | |
|---|---|---|---|---|
| 4,546,554 | A * | 10/1985 | Bullock | D06F 58/30 34/554 |
| 6,845,536 | B1 | 1/2005 | Vaidhyanathan et al. | |
| 9,482,172 | B2 * | 11/2016 | Pursifull | F02D 41/005 |
| 2006/0007008 | A1 * | 1/2006 | Kates | G01M 3/3245 340/618 |
| 2009/0308155 | A1 | 12/2009 | Zhang | |

FOREIGN PATENT DOCUMENTS

| | | | |
|---|---|---|---|
| CN | 112593380 | A | 4/2021 |
| WO | WO2017/153276 | A1 | 9/2017 |

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

A laundry appliance includes a basket rotatably mounted within a cabinet and defining a chamber configured for receiving a load of clothes, a water supply valve for regulating a flow of water into the chamber, and a humidity sensor positioned within the cabinet for monitoring a chamber humidity. A controller is configured to determine that the water supply valve is open to permit the flow of water into the chamber, identify an anticipated humidity within the chamber based at least in part on the water supply valve being open, obtain the chamber humidity using the humidity sensor, and implementing a responsive action if the chamber humidity does not correspond to the anticipated humidity.

20 Claims, 5 Drawing Sheets

WATER TEMPERATURE EVALUATION METHOD USING A HUMIDITY SENSOR IN A LAUNDRY APPLIANCE

FIELD OF THE INVENTION

The present subject matter relates generally to laundry appliances, or more specifically, to the use of humidity sensors to evaluate water temperature in laundry appliances.

BACKGROUND OF THE INVENTION

Laundry appliances such as washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle of a washing machine appliance, a drain pump assembly may operate to discharge water from within sump.

Washing machine appliances typically include a water supply system and/or valve assembly for providing hot and/or cold water into the wash tub to generate a wash fluid to facilitate a wash cycle. These water supply systems typically include separate hot water and cold water hookup ports. However, users frequently swap the hot water and cold water lines upon installation. As a result, when the washing machine requests hot water, it may receive cold water, and vice versa. Similarly, dryer appliances may include a water supply for providing water to produce steam for steam dry cycles. Various situations may arise that result in water being supplied at the incorrect temperature. For example, issues with hot water supply, such as hot water heaters, may result in water that is too hot or not hot enough. Improper water temperatures may result in the degradation of operating cycle performance and overall user dissatisfaction.

Accordingly, a laundry appliance including features and operating methods for ensuring operating cycles are performed with water at target temperatures would be desirable. More specifically, a method for identifying situations where the temperature of supplied water in a laundry appliance is not within a suitable temperature range would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided including a cabinet, a basket rotatably mounted within the cabinet and defining a chamber configured for receiving a load of clothes, a water supply valve for regulating a flow of water into the chamber, a humidity sensor positioned within the cabinet for monitoring a chamber humidity, and a controller operably coupled to the water supply valve and the humidity sensor. The controller is configured to determine that the water supply valve is open to permit the flow of water into the chamber, identify an anticipated humidity within the chamber based at least in part on the water supply valve being open, obtain the chamber humidity using the humidity sensor, determine that the chamber humidity does not correspond to the anticipated humidity, and implement a responsive action in response to determining that the chamber humidity does not correspond to the anticipated humidity.

In another exemplary embodiment, a method of operating a washing machine appliance is provided. The washing machine appliance includes a wash basket rotatably mounted within a wash tub and defining a wash chamber configured for receiving a load of clothes, a water supply valve for regulating a flow of water into the wash chamber, and a humidity sensor positioned within the wash tub for monitoring a chamber humidity. The method includes determining that the water supply valve is open to permit the flow of water into the wash chamber, identifying an anticipated humidity within the wash chamber based at least in part on the water supply valve being open, obtaining the chamber humidity using the humidity sensor, determining that the chamber humidity does not correspond to the anticipated humidity, and implementing a responsive action in response to determining that the chamber humidity does not correspond to the anticipated humidity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
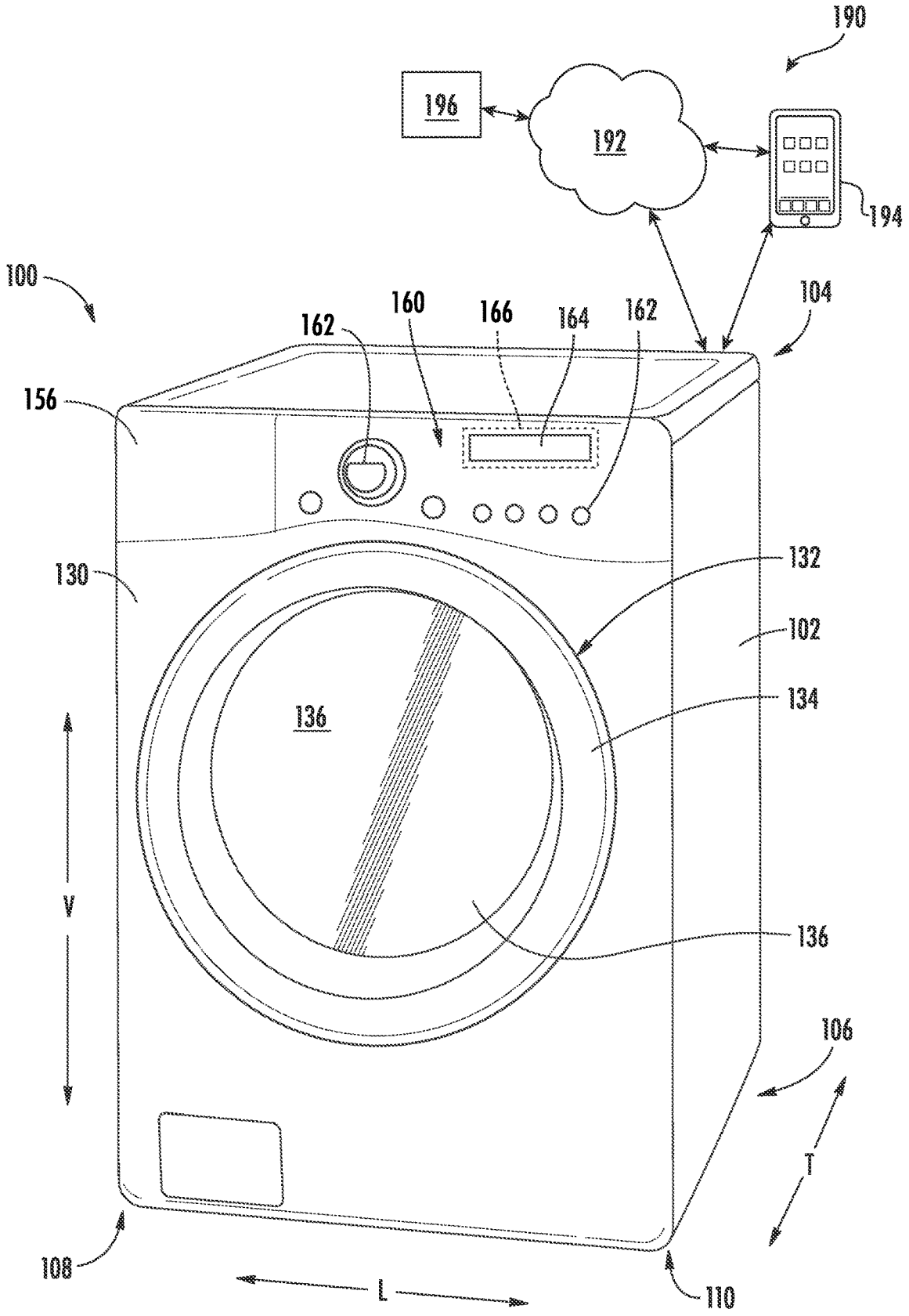
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
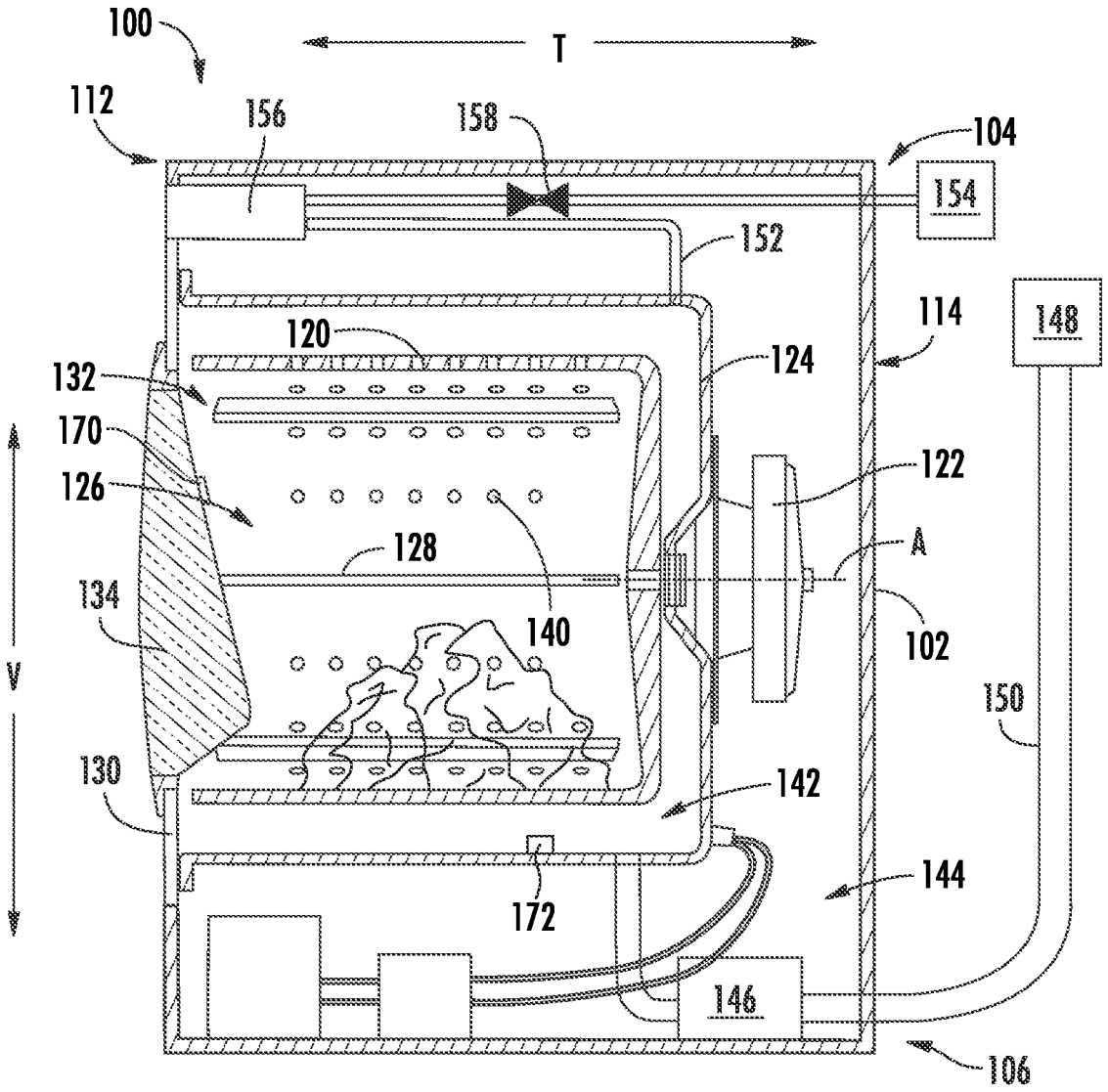
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve assembly 158 may provide a flow of water from a water supply source (such as a municipal water supply 154) into detergent dispenser 156 and into wash tub 124. In this manner, water supply valve assembly 158 may generally be operable to supply water into detergent dispenser 156 to generate a wash fluid, e.g., for use in a wash cycle, or a flow of fresh water, e.g., for a rinse cycle. It should be appreciated that water supply valve assembly 158 may be positioned at any other suitable location within cabinet 102.

Moreover, it should be appreciated that water supply valve assembly 158 may include a plurality of water supply valves for independently regulating different flows of water. In this regard, for example, water supply valve assembly 158 may include two ports for receiving a hot water supply line and a cold water supply line. Water supply valve assembly 158 may further include a hot water supply valve for selectively regulating the flow of water to the hot water supply line and a cold water supply valves for selectively regulating the flow of water through the cold water supply line.

According to exemplary embodiments, the cold water supply valve and the hot water supply valve may be moved between an open position and a closed position at a certain frequency and/or duration to adjust a temperature of the flow of water. Thus, for example, if warm water is desired but the supplied water is not hot enough, the duration of time that the cold water valve is open may be decreased and the duration of time that the hot water valve is open may be increased. In addition, although water supply valve assembly 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Referring now specifically to FIG. 2, washing machine appliance 100 may further include one or more sensors that are generally positioned within wash tub 124 to provide useful information regarding the environment within wash tub 124, e.g., to facilitate improved process control and appliance performance. In this regard, for example, washing machine appliance includes a humidity sensor 170 that is generally configured for monitoring a chamber humidity within wash tub 124. According to the illustrated exemplary embodiment, humidity sensor 170 is mounted to an inner window of door 134. In this manner, electrical power and data transmission lines may be routed through a door gasket and may be operably coupled to humidity sensor 170. However, it should be appreciated that according to alternative embodiments humidity sensor 170 may be positioned at any other location suitable for monitoring chamber humidity.

As used herein, the terms "humidity sensor" or the equivalent may be intended to refer to any suitable type of humidity measuring system or device positioned at any suitable location for measuring the desired humidity. Thus, for example, "humidity sensor" may refer to any suitable type of humidity sensor, such as capacitive digital sensors, resistive sensors, and thermal conductivity humidity sensors. In addition, humidity sensor 170 may be positioned at any suitable location and may output a signal, such as a voltage, to a controller that is proportional to and/or indicative of the humidity being measured. Although exemplary positioning of humidity sensors is described herein, it should be appreciated that washing machine appliance 100 may include any other suitable number, type, and position of humidity sensors according to alternative embodiments.

Similarly, washing machine appliance 100 may include a temperature sensor 172 that is generally configured for monitoring a temperature of wash fluid within wash tub 124. According to the illustrated exemplary embodiment, temperature sensor 172 is mounted within sump 142 of washing machine appliance 100. In this manner, temperature sensor 172 may be in direct contact with wash fluid that collects therein. However, it should be appreciated that according to alternative embodiments temperature sensor 172 may be positioned at any other location suitable for monitoring wash fluid temperature, e.g., such as below spout 152 of water supply 154.

As used herein, "temperature sensor" or the equivalent is intended to refer to any suitable type of temperature measuring system or device positioned at any suitable location for measuring the desired temperature. Thus, for example, temperature sensor 172 may each be any suitable type of temperature sensor, such as a thermistor, a thermocouple, a resistance temperature detector, a semiconductor-based integrated circuit temperature sensors, etc. In addition, temperature sensor 172 may be positioned at any suitable location and may output a signal, such as a voltage, to a controller that is proportional to and/or indicative of the temperature being measured. Although exemplary positioning of temperature sensors is described herein, it should be appreciated that washing machine appliance 100 may include any other suitable number, type, and position of temperature sensors according to alternative embodiments.

Notably, controller 166 of washing machine appliance 100 (or any other suitable dedicated controller) may be communicatively coupled to humidity sensor 170, temperature sensor 172, and other components of washing machine appliance 100. As explained in more detail below, controller 166 may be programmed or configured for monitoring chamber temperatures and humidity to identify the occurrence of water supply or regulation issues. In addition, controller 166 may be programmed or configured to perform methods to evaluate the temperature of water being supplied into the wash tub 124 and take corrective action.

Referring still to FIG. 1, a schematic diagram of an external communication system 190 will be described according to an exemplary embodiment of the present subject matter. In general, external communication system 190 is configured for permitting interaction, data transfer, and other communications with washing machine appliance 100. For example, this communication may be used to provide and receive operating parameters, cycle settings, performance characteristics, user preferences, user notifications, or any other suitable information for improved performance of washing machine appliance 100.

External communication system 190 permits controller 166 of washing machine appliance 100 to communicate with external devices either directly or through a network 192. For example, a consumer may use a consumer device 194 to communicate directly with washing machine appliance 100. For example, consumer devices 194 may be in direct or indirect communication with washing machine appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with washing machine appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with washing machine appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, aspects of the present subject matter may be utilized in a combination washer/dryer appliance. Indeed, it should be appreciated that aspects of the present subject matter may further apply to other laundry appliances, such a dryer appliance. In this regard, the same methods and systems as described herein may be used to evaluate water temperatures in other appliances, such as a steam dryer.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 3:
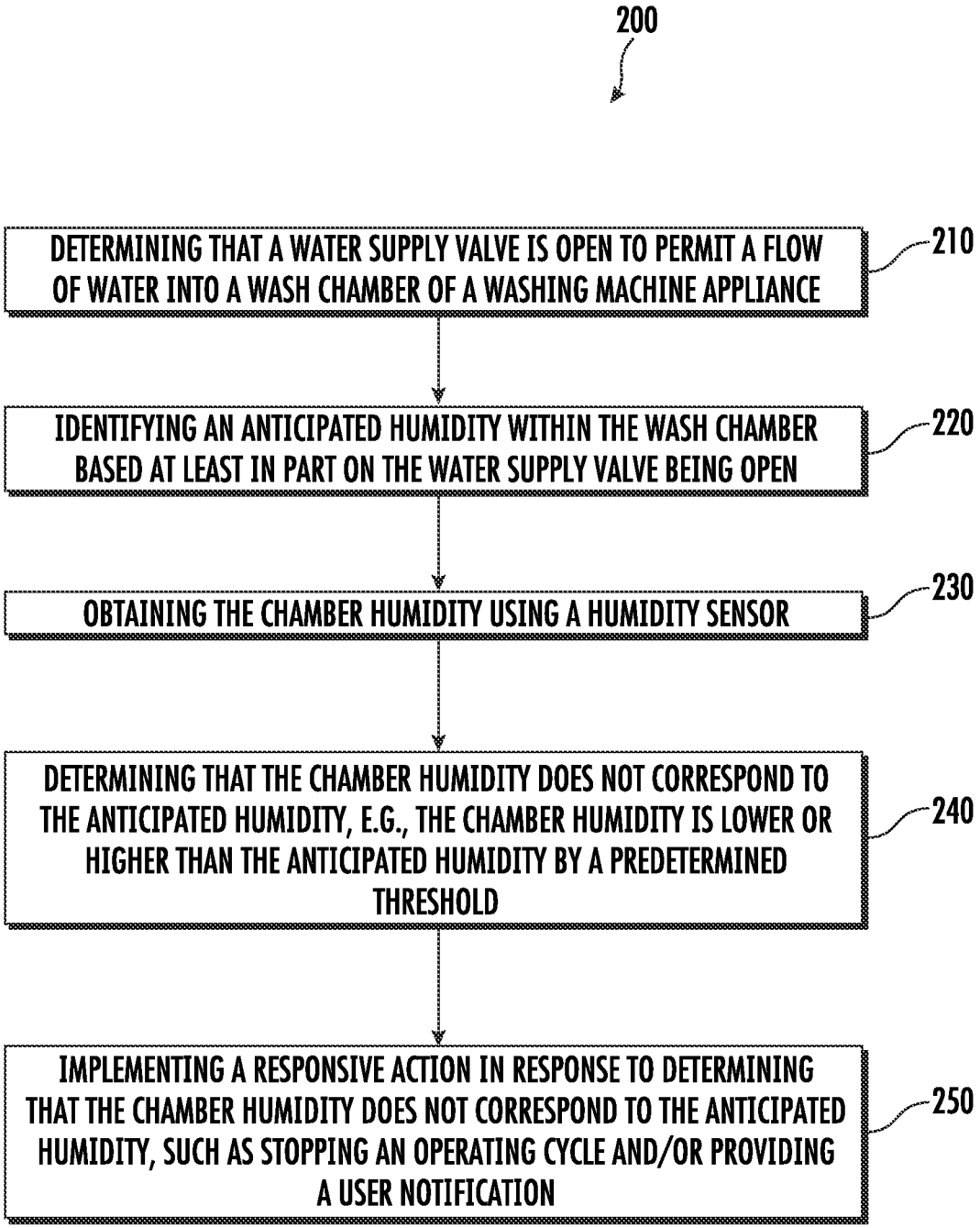
FIG. 3 illustrates a method for operating a washing machine appliance in accordance with one embodiment of the present disclosure.

Referring now to FIG. 3, method 200 includes, at step 210, determining that a water supply valve is open to permit a flow of water into a chamber of a laundry appliance. In this regard, continuing example from above, water supply valve assembly 158 may be used to selectively open or close a hot water supply valve (e.g., which is operably coupled to a hot water supply port) and/or a cold water supply valve (e.g., which is operably coupled to a cold water supply port). In general, controller 166 of washing machine appliance 100 may be programmed to selectively open or close these supply valves to obtain the desired amount and temperature of water to facilitate the performance of a particular operating cycle of the machine.

When water supply conduits are connected properly, the hot water heater is supplying water the appropriate temperatures, and no other system failures affect the water temperature, controller 166 may consistently regulate water supply valve assembly 158 to obtain the desired water volume and temperature. However, as explained above, various events may result in the supplied water not having the desired temperature. For example, a user may inadvertently swap the hot and cold water supply conduits, such that the hot water supply valve is regulating a flow of water from a cold water supply, and vice versa. In addition, water heaters may fail to provide water at a suitable temperature, other heaters internal to the appliance may fail, valves or flow regulating devices may malfunction, etc. As such, aspects of the present subject matter are generally directed to detecting such situations or conditions.

Specifically, method 200 may further include, at step 220, identifying an anticipated humidity within the chamber based at least in part on the water supply valve being open. In this regard, for example, if controller 166 commands one or more of the hot and cold water supply valves to be open, controller 166 may further anticipate the chamber humidity that is anticipated within wash chamber 126 as result of the wash fluid being supplied therein. Method 200 may be used to take corrective action in the event the chamber humidity is not as anticipated after opening up the hot or cold water supply valve.

Notably, it should be appreciated that it may take some time for the chamber humidity to rise after opening a water supply valve. Accordingly, method 200 may further include implementing a time delay between the step of determining that the water supply valve is open and the step of obtaining the chamber humidity. In this manner, the flow of wash fluid may be dispensed and the chamber humidity may stabilize at least partially before measurements are obtained. According to exemplary embodiments, the time delay may be between about 5 seconds and 1 minute, between about 10 seconds and 45 seconds, or about 30 seconds.

As used herein, the terms "anticipated humidity" and the like are generally intended to refer to the relative humidity at a specific location within wash tub 124 (e.g., that is representative of average chamber humidity) at a specific time after operation of a water supply valve. It should be appreciated that these values may be a specific percent humidity, such as 50%, 60%, 70%, 80%, or 90% humidity. According to alternative embodiments, the anticipated humidity may refer to a humidity range, such as between 50-60% humidity, between 60-70% humidity, between 70-80% humidity, between 80-90% humidity, etc. According to exemplary embodiment, and as explained in more detail below, the chamber humidity may be compared directly with the anticipated humidity or with a humidity tolerance range that surrounds the anticipated humidity.

In this regard, for example, if controller 166 opens the hot water supply valve and thus expects hot water to be dispensed, controller 166 may anticipate that the chamber humidity within wash chamber 126 will rise quickly. As such, the anticipated humidity may be approximated by controller 166. By contrast, if controller 166 opens the cold water supply valve and thus expects that cold water will be dispensed, controller 166 may anticipate that there will not be a significant increase in humidity within the chamber. As such the anticipated humidity may be lower in the event only a cold water valve is opened.

Figure 5:
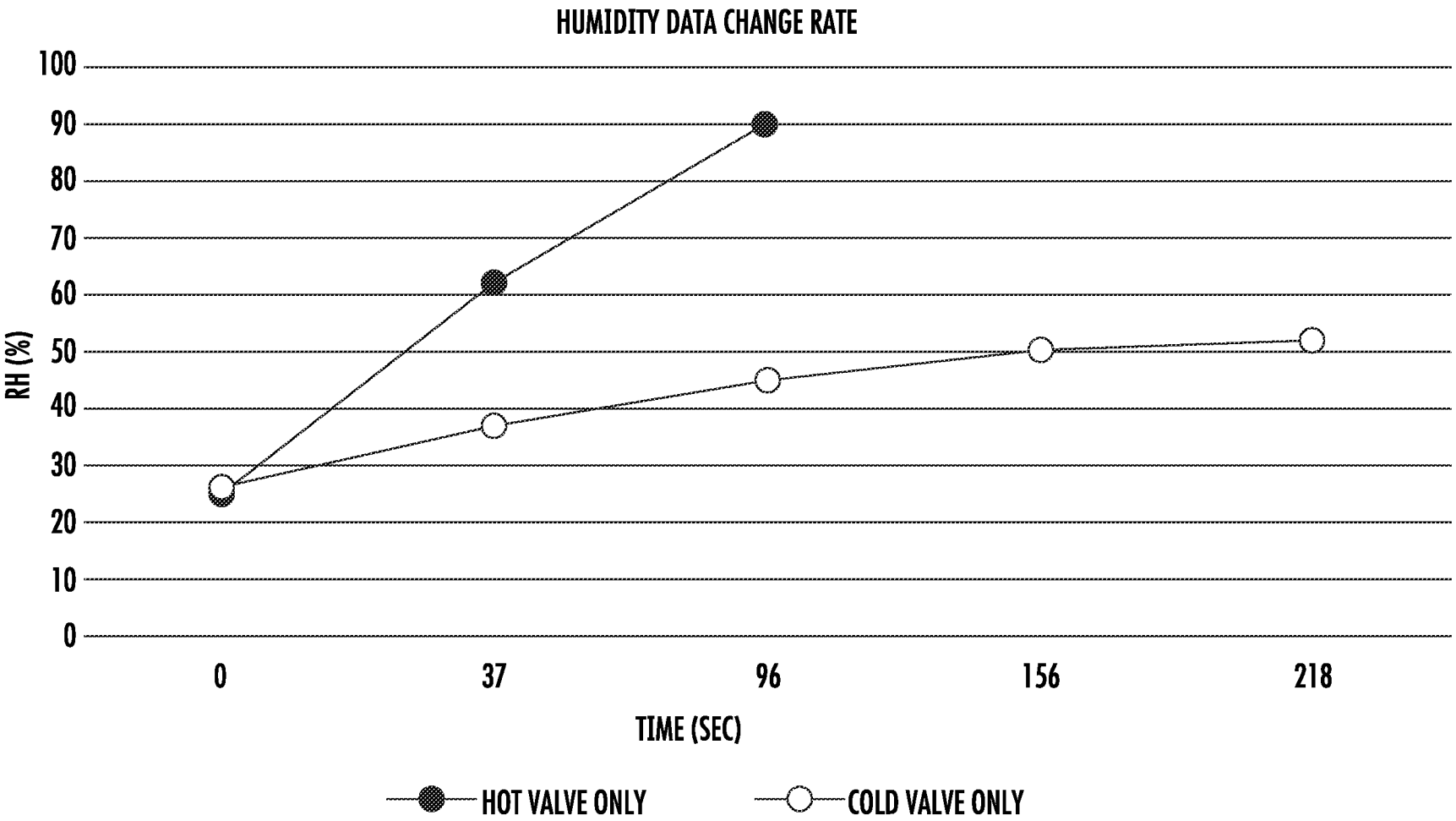
FIG. 5 provides a plot of the relative humidity within a wash chamber over time when hot water or cold water is being supplied according to an exemplary embodiment.

Referring again to FIG. 3, step 230 may include obtaining the chamber humidity using a humidity sensor. For example, humidity sensor 170 may continuously or periodically monitor the chamber humidity within wash chamber 126 and may communicate this information to controller 166 to facilitate performance of method 200. For example, referring briefly to FIG. 5, a plot of the percentage relative humidity over time is provided when hot or cold water is being supplied. Step 240 may generally include determining that the chamber humidity does not correspond to the anticipated humidity. In this regard, as explained briefly above, controller 166 may determine that the chamber humidity does not correspond to the anticipated humidity if the chamber humidity is lower or higher than the anticipated humidity by a predetermined threshold. For example, the controller 166 may be programmed with empirical or theoretical humidity data like that shown in FIG. 5 and may use this data to determine an anticipated humidity based on valve positions.

Specifically, for example, if controller 166 opens a hot water supply valve, the anticipated humidity after a predetermined time delay may be 90%. Thus, if the chamber humidity measured at step 230 is significantly different than 90%, controller 166 may determine that there is not correspondence between the measured and anticipated humidity and may determine that an issue with the water supply has occurred. Notably, a significant difference may be determined by a variation between the chamber humidity and the anticipated humidity that is greater than some predetermined threshold, such as a percentage measured relative to the anticipated humidity (e.g., plus or minus 5% relative to the anticipated humidity). According to exemplary embodiments, controller 166 may determine that the chamber humidity does not correspond to the anticipated humidity if the chamber humidity falls outside of the humidity tolerance range that surrounds the anticipated humidity (e.g., between 85% and 95% humidity in accordance with example above where the anticipated humidity is 90%). Thus, for example, if the chamber humidity falls below the lower boundary of that humidity tolerance range (e.g., 85%), controller 166 may determine that the water supply lines are swapped or that there is a failure with the hot water heater.

By contrast, if controller 166 has opened a cold water supply valve, the anticipated humidity after a predetermined time delay may be relatively low, such as 50%. Thus, if the chamber humidity measured at step 230 is significantly different than 50%, controller 166 may determine that there is not correspondence between the measured and anticipated humidity and may determine that an issue with the water supply has occurred. Notably, a significant difference may be determined by a variation between the chamber humidity and the anticipated humidity that is greater than some predetermined threshold, such as a percentage measured relative to the anticipated humidity (e.g., plus or minus 5% relative to the anticipated humidity). According to exemplary embodiments, controller 166 may determine that the chamber humidity does not correspond to the anticipated humidity if the chamber humidity falls outside of the humidity tolerance range that surrounds the anticipated humidity (e.g., between 45% and 55% humidity in accordance with example above). Thus, for example, if the chamber humidity exceeds the upper boundary of that humidity tolerance range (e.g., 55%), controller 166 may determine that the water supply lines are swapped or that hot water is being inadvertently supplied.

Step 250 may include implementing a responsive action in response to determining that the chamber humidity does not correspond anticipated humidity. For example, according to an exemplary embodiment, implementing the responsive action may include adjusting at least one operating parameter of the washing machine appliance 100. As used herein, an "operating parameter" of washing machine appliance 100 is any cycle setting, operating time, component setting, spin speed, part configuration, water level, water temperature, detergent volume, or other operating characteristic that may affect the performance or operation of washing machine appliance 100. Thus, references to operating parameter adjustments or "adjusting at least one operating parameter" are intended to refer to control actions intended to correct issues related to the operation of washing machine appliance in response to determining that the chamber humidity does not correspond to the anticipated humidity.

For example, controller 166 may be configured for stopping the operating cycle until a user troubleshoots the water supply issue. By contrast, controller 166 may operate the water supply valve assembly 158 to compensate for the improper water temperature. In this regard, for example, controller 166 may adjust the position of the water supply valves to increase or decrease the flows of water. More specifically, if the water is too hot (e.g., as indicated by higher humidity than anticipated), controller 166 may close the hot water supply valve and/or open the cold water supply valve. By contrast, if the water is too cold (e.g., as indicated by lower humidity than anticipated), controller 166 may close the cold water supply valve and/or open the hot water supply valve. Other operating parameter adjustments are possible and within the scope of the present subject matter.

In addition, step 250 of implementing a responsive action may further include providing a user notification that the anticipated and actual humidity do not match. The notification may further include recommended troubleshooting instructions or other actions that may be taken to rectify the issue. It should be appreciated that the user notification is optional and may be provided to the user from any suitable source and in any suitable manner. For example, according to exemplary embodiments, the user notification may be provided through control panel 160 so that the user may be aware of the operating cycle. In addition, or alternatively, controller 166 may be configured to provide a user notification to a remote device, such as remote device 194 via a network 192. Whether provided via control panel 160, remote device 194, or by other means, this user notification may include useful information regarding the appropriate water connections, a quantification of the target versus actual humidity level, etc.

Notably, if the measured chamber humidity is close to the anticipated humidity, method 200 may include operating washing machine appliance 100 normally. Thus, method 200 may further include determining that the chamber humidity is within a humidity tolerance range surrounding the anticipated humidity and proceeding with an operating cycle in response to determining that the chamber humidity is within the humidity tolerance range.

According to exemplary embodiments, controller 166 of washing machine appliance 100 may use humidity sensor 170 and temperature sensor 172 in unison to provide a failsafe manner of detecting water supply temperatures. In this regard, method 200 may include using temperature sensor to measure a wash fluid temperature and the anticipated wash fluid temperature and these values may be compared in a manner similar to that described above the chamber humidity.

Figure 4:
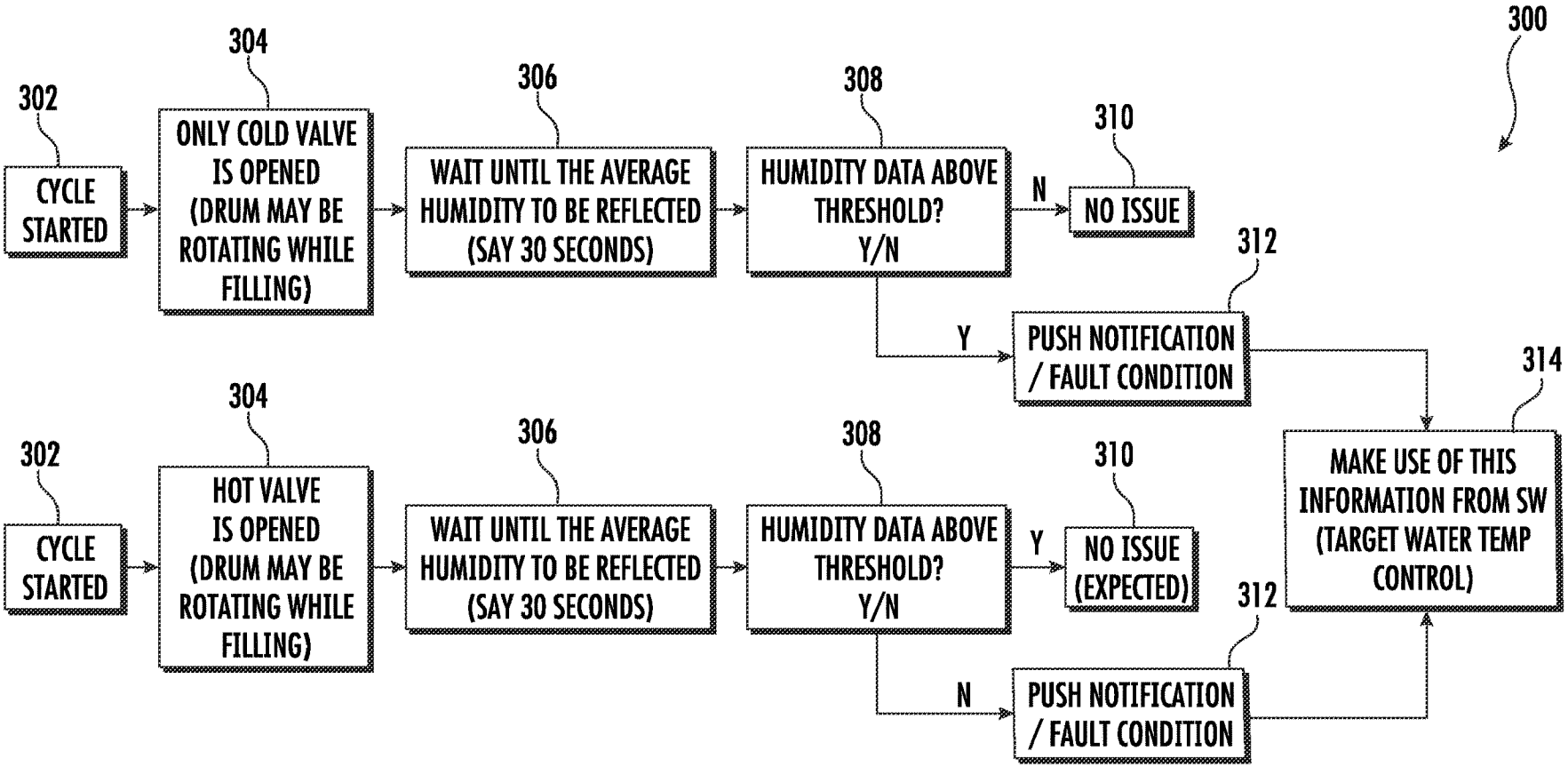
FIG. 4 illustrates a flow diagram illustrating an exemplary process for evaluating water temperature according to an exemplary embodiment of the present subject matter.

Referring now briefly to FIG. 4, an exemplary flow diagram of a water temperature evaluation method 300 that may be implemented by washing machine appliance 100 will be described according to an exemplary embodiment of the present subject matter. According to exemplary embodiments, method 300 may be similar to or interchangeable with all or a portion of method 200 and may be implemented by controller 166 of washing machine appliance 100. As shown, at step 302, method 300 may include starting an operating cycle of a washing machine appliance, such as washing machine appliance 100.

Depending on the operating cycle the wash chamber 126 is preferably filled with a certain volume of water having a certain desired temperature. As such, step 304 may include regulating a valve assembly to provide the desired volume and temperature of water. Specifically, as illustrated, step 304 may include opening the cold water supply valve, opening the hot water supply valve, or some combination therebetween. Regardless of which water supply valve is opened, step 306 may include waiting until the chamber humidity has had an opportunity to normalize. As noted above, this time delay may be any suitable time, such as 10 seconds, 30 seconds, 1 minute, etc.

Step 308 may generally include obtaining an actual chamber humidity and comparing that chamber humidity to an anticipated humidity threshold, e.g., such as the anticipated humidity or corresponding humidity tolerance range as described above. Depending on whether the controller intended to dispense cold water or hot water, step 310 may include determining that the chamber humidity was as anticipated. In this event, no issue with a water supply valve is detected and the operating cycle may proceed as usual. More specifically, if only the cold water valve were open and step 308 resulted in a determination that the measured chamber humidity was not above the predetermined humidity threshold, the operating cycle may proceed as usual. Similarly, if a hot water valve was opened and step 308 resulted in a determination that the measured chamber humidity was above the predetermined humidity threshold, the operating cycle may proceed as usual.

By contrast, if the measured chamber humidity detected at step 308 is not the same as the anticipated humidity (e.g., high humidity when cold water valve is open or low humidity when hot water valve is open), step 312 may include implementing a responsive action, such as sending a push notification to a mobile device or otherwise triggering a fault condition within washing machine appliance 100. As illustrated at step 314, washing machine appliance 100 may further be configured for manipulating operation to compensate for the improper water temperature. In this regard, washing machine appliance 100 may stop the cycle if the problem cannot be rectified, may add additional hot water if the water temperature is too cold (e.g., low humidity detected), and/or may add more cold water in the event the water temperature is too hot (e.g., high humidity is detected).

It should be appreciated that methods 200 and 300 may both implement debounce procedures to prevent false triggers of a fault condition related to the water supply system. In this regard, if the measured chamber humidity does not match the anticipated humidity during a single comparison, the methods may include repeating the comparison any suitable number of times to ensure that an issue actually exists or waiting for chamber humidity to normalize. In this manner, the claimed methods can avoid or disregard nuisance trips or situations where there is not a water supply issue. In addition, it should be appreciated that the differences in chamber humidity may be one of degree, and these methods may use any suitable thresholds for determining whether a measured chamber humidity is sufficiently distinct from that anticipated to trigger a fault condition resulting in operating parameter adjustments, user notifications, etc.

FIGS. 3 and 4 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable laundry appliance, such as another washing machine appliance or a dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:

a cabinet;

a basket rotatably mounted within the cabinet and defining a chamber configured for receiving a load of clothes;

a water supply valve for regulating a flow of water into the chamber;

a humidity sensor positioned within the cabinet for monitoring a chamber humidity; and a controller operably coupled to the water supply valve and the humidity sensor, the controller being configured to:

determine that the water supply valve is open to permit the flow of water into the chamber;

identify an anticipated humidity within the chamber based at least in part on the water supply valve being open, the anticipated humidity being empirical or theoretical humidity data stored by the controller;

obtain the chamber humidity using the humidity sensor;

determine that the chamber humidity does not correspond to the anticipated humidity; and implement a responsive action in response to determining that the chamber humidity does not correspond to the anticipated humidity.

2. The laundry appliance of claim 1, wherein the water supply valve is a hot water supply valve and wherein determining that the chamber humidity does not correspond to the anticipated humidity comprises:

obtaining a first humidity threshold based on the anticipated humidity; and determining that the chamber humidity is below the first humidity threshold.

3. The laundry appliance of claim 2, wherein the first humidity threshold is a lower boundary of a humidity tolerance range surrounding the anticipated humidity.

4. The laundry appliance of claim 1, wherein the water supply valve is a cold water supply valve and wherein determining that the chamber humidity does not correspond to the anticipated humidity comprises:

obtaining a second humidity threshold based on the anticipated humidity; and determining that the chamber humidity is above the second humidity threshold.

5. The laundry appliance of claim 4, wherein the second humidity threshold is an upper boundary of a humidity tolerance range surrounding the anticipated humidity.

6. The laundry appliance of claim 1, wherein implementing the responsive action comprises:

adjusting the water supply valve.

7. The laundry appliance of claim 1, wherein implementing the responsive action comprises:

stopping an operating cycle of the laundry appliance.

8. The laundry appliance of claim 1, wherein implementing the responsive action comprises:

providing a user notification regarding a potential fault condition with a water supply.

9. The laundry appliance of claim 8, further comprising:

a user interface panel, wherein the user notification is provided through the user interface panel.

10. The laundry appliance of claim 8, wherein the controller is in operative communication with a remote device through an external network, and wherein the user notification is provided through the remote device.

11. The laundry appliance of claim 1, wherein the controller is further configured to:

determine that the chamber humidity is within a humidity tolerance range surrounding the anticipated humidity; and proceed with an operating cycle in response to determining that the chamber humidity is within the humidity tolerance range surrounding the anticipated humidity.

12. The laundry appliance of claim 1, wherein the controller is further configured to:

implement a time delay between the step of determining that the water supply valve is open and the step of obtaining the chamber humidity.

13. The laundry appliance of claim 1, further comprising a temperature sensor positioned within the cabinet for monitoring a wash fluid temperature, wherein the controller is further operably coupled to the temperature sensor and is configured to:

identify an anticipated temperature within the chamber based at least in part on the water supply valve being open;

obtain the wash fluid temperature using the temperature sensor;

determine that the wash fluid temperature does not correspond to the anticipated temperature; and implement a responsive action in response to determining that the wash fluid temperature does not correspond to the anticipated temperature.

14. The laundry appliance of claim 1, wherein the laundry appliance is a horizontal axis washing machine appliance.

15. A method of operating a washing machine appliance, the washing machine appliance comprising a wash basket rotatably mounted within a wash tub and defining a wash chamber configured for receiving a load of clothes, a water supply valve for regulating a flow of water into the wash chamber, and a humidity sensor positioned within the wash tub for monitoring a chamber humidity, the method comprising:

determining that the water supply valve is open to permit the flow of water into the wash chamber;

identifying an anticipated humidity within the wash chamber based at least in part on the water supply valve being open, the anticipated humidity being empirical or theoretical humidity data;

obtaining the chamber humidity using the humidity sensor;

determining that the chamber humidity does not correspond to the anticipated humidity; and implementing a responsive action in response to determining that the chamber humidity does not correspond to the anticipated humidity.

16. The method of claim 15, wherein the water supply valve is a hot water supply valve and wherein determining that the chamber humidity does not correspond to the anticipated humidity comprises:

obtaining a first humidity threshold based on the anticipated humidity; and determining that the chamber humidity is below the first humidity threshold.

17. The method of claim 15, wherein the water supply valve is a cold water supply valve and wherein determining that the chamber humidity does not correspond to the anticipated humidity comprises:

obtaining a second humidity threshold based on the anticipated humidity; and determining that the chamber humidity is above the second humidity threshold.

18. The method of claim 15, wherein implementing the responsive action comprises:

providing a user notification regarding a potential fault condition with a water supply.

19. The method of claim 15, further comprising:

determining that the chamber humidity is within a humidity tolerance range surrounding the anticipated humidity; and proceeding with an operating cycle in response to determining that the chamber humidity is within the humidity tolerance range surrounding the anticipated humidity.

20. The method of claim 15, further comprising:

implementing a time delay between the step of determining that the water supply valve is open and the step of obtaining the chamber humidity.

* * * * *